US011217085B2

(12) United States Patent
Govindaraj et al.

(10) Patent No.: US 11,217,085 B2
(45) Date of Patent: Jan. 4, 2022

(54) REAL TIME INTERVENTION PLATFORM FOR AT-RISK CONDUCT

(71) Applicant: Tetra Ventures LLC, New Brunswick, NJ (US)

(72) Inventors: Raghuraman Govindaraj, New Brunswick, NJ (US); Sanjay Ungarala, New Brunswick, NJ (US); Sharad Rao, New Brunswick, NJ (US)

(73) Assignee: Tetra Ventures LLC, New Brunswick, NJ (US)

( * ) Notice: Subject to any disclaimer, the term of this patent is extended or adjusted under 35 U.S.C. 154(b) by 0 days.

(21) Appl. No.: 16/805,959

(22) Filed: Mar. 2, 2020

(65) Prior Publication Data

US 2021/0272443 A1 Sep. 2, 2021

(51) Int. Cl.

| | |
|---|---|
| ***G08B 25/00*** | (2006.01) |
| ***G08B 21/18*** | (2006.01) |
| ***G08B 25/01*** | (2006.01) |
| ***G06Q 50/26*** | (2012.01) |

(52) U.S. Cl.

CPC ..... *G08B 25/006* (2013.01); *G06Q 50/265* (2013.01); *G08B 21/182* (2013.01); *G08B 25/016* (2013.01)

(58) Field of Classification Search

CPC .. G08B 25/006; G08B 21/182; G08B 25/016; G06Q 50/265

See application file for complete search history.

(56) References Cited

U.S. PATENT DOCUMENTS

| | | | | |
|---|---|---|---|---|
| 6,601,012 | B1 | 7/2003 | Horvitz et al. | |
| 8,804,915 | B2 * | 8/2014 | Kiet | H04M 3/493 379/38 |
| 8,866,869 | B2 * | 10/2014 | Fennell | G08B 21/22 348/14.02 |
| 9,032,531 | B1 * | 5/2015 | Scorvo | H04L 63/1408 726/25 |
| 9,324,119 | B2 * | 4/2016 | Singh | G06Q 50/265 |
| 10,115,283 | B1 * | 10/2018 | Sokolov | G08B 21/0453 |
| 10,282,702 | B2 * | 5/2019 | Paltenghe | G06Q 10/06 |
| 10,375,187 | B1 * | 8/2019 | Marlin | H04L 67/22 |
| 10,573,146 | B1 * | 2/2020 | Jordan, II | G08B 21/0461 |
| 10,642,957 | B1 * | 5/2020 | Pinsonneault | G16H 20/10 |
| 10,887,335 | B2 * | 1/2021 | Pilkington | H04L 63/1425 |
| 10,891,843 | B2 * | 1/2021 | Kwatra | G08B 21/0446 |
| 11,062,584 | B1 * | 7/2021 | Magaletta | A61B 5/117 |
| 2006/0233310 | A1 | 10/2006 | Adams, Jr. et al. | |

(Continued)

*Primary Examiner* — Chico A Foxx

(74) *Attorney, Agent, or Firm* — Andrew Berks; Gallet Dreyer & Berkey LLP

(57) ABSTRACT

A system for generating automated notifications by aggregating data to provide alerts to interdict at-risk conduct. In the system, an aggregator application accesses a plurality data sources addressing at-risk conduct. The aggregator application generates reports of incidents of at-risk conduct by specific individuals and stores the reports in a database. A dynamic risk computation engine scores each individual for their risk of engaging in at-risk conduct according to metadata on contacts of that individual within the plurality of data sources. Any individual having a score exceeding a pre-determined threshold triggers an alarm and a notification is provided in real time to competent authorities to allow a responsible person to make a timely intervention.

3 Claims, 2 Drawing Sheets

(56) References Cited

U.S. PATENT DOCUMENTS

| | | | | |
|---|---|---|---|---|
| 2007/0285258 | A1* | 12/2007 | Hartman | G08B 21/22 340/573.1 |
| 2011/0141974 | A1* | 6/2011 | Lieberman | H04L 51/38 370/328 |
| 2013/0024211 | A1* | 1/2013 | Monteforte | G06Q 30/00 705/3 |
| 2013/0090941 | A1* | 4/2013 | Taylor | G06Q 40/08 705/2 |
| 2013/0120518 | A1* | 5/2013 | Kiet | H04M 3/2218 348/14.01 |
| 2014/0337277 | A1 | 11/2014 | Asenjo et al. | |
| 2015/0006456 | A1* | 1/2015 | Sudharsan | G16H 40/67 706/46 |
| 2015/0339791 | A1* | 11/2015 | Tetteh | G16H 50/20 705/2 |
| 2017/0213445 | A1* | 7/2017 | Kusens | G08B 25/006 |
| 2018/0032612 | A1* | 2/2018 | Kariman | G06F 16/164 |
| 2018/0176727 | A1* | 6/2018 | Williams | A61B 5/747 |
| 2019/0282096 | A1* | 9/2019 | Vardi | A61B 5/02438 |
| 2019/0385744 | A1* | 12/2019 | Freeman | A61B 5/7267 |
| 2020/0258634 | A1* | 8/2020 | Ravindranathan | G06K 9/6257 |

* cited by examiner

REAL TIME INTERVENTION PLATFORM FOR AT-RISK CONDUCT

CROSS REFERENCE TO RELATED APPLICATION

This patent application claims priority to U.S. Patent Application 62/812,653, filed Mar. 1, 2019, the contents of which are incorporated by reference.

FIELD OF THE INVENTION

This invention pertains to the collection and processing of information from disparate data sources and domains, pertaining to drug abuse, violence, and other at-risk conduct, and the production of alerts for disciplinary, therapeutic, and law-enforcement intervention.

BACKGROUND

According to the Center for Disease Control and Prevention, states in the Northeast, including New Jersey, New York and Connecticut, saw statistically significant increases in drug overdose death rates from 2015 to 2016. In 2015, New Jersey recorded 1,454 overdose deaths and in 2016 there were 2,056, an increase of 41%. (https://www.cdc.gov/drugoverdose/data/statedeaths.html)

A major challenge to successfully addressing this issue in a proactive manner is that while individuals that have, for example, opioid addictions, commonly have multiple contacts with numerous agencies in local governments across multiple domains such as law enforcement, recovery services, and health care institutions. But, the sharing of cross-domain information is usually very fragmented, resulting in the inability to provide proactive intervention.

The major fragmentation and the siloed data systems that each stakeholder uses to collect and store data typically do not communicate with each other, leading to an inability to provide a holistic view of an individual. This hampers efforts to provide a multi-disciplinary intervention. Stakeholders include law enforcement, pretrial services, the courts, corrections services, firearms registration agencies, probation and parole, child welfare, Prescription Drug Monitoring Programs (PDMPs), emergency medical services, health care providers, hospitals, public health partners, and agencies that provide substance misuse treatment and recovery support services. This information, if shared across domains, could be absolutely impactful in enhancing public safety and helping to improve the continuity of care and outcomes for individuals impacted by the opioid crisis, other drug abuse, violence, and other anti-social conduct.

For example, some common features to many of the school shootings across the country include:

- Data is stored in multiple siloed systems with no integration across domains such as law enforcement, children protective services, health care, etc.
- An inability to integrate information to provide a composite picture of an individual.
- A substantial amount of manual intervention is required to "connect-the-dots" for high risk or threatening behaviors.
- No continuous monitoring process to identify the risk level of individuals in a dynamic manner.
- An inability to flag individuals as high risk when incidents occur for timely intervention.
- Lack of automated systems to capture tips and leads from different sources to identify trends and patterns.

Accordingly, an automated method to integrate data from a variety of siloed information sources and provide a multi-disciplinary response to at-risk (also termed antisocial) conduct can make society safer and provide effective and timely treatment and intervention options for the individuals involved.

SUMMARY OF THE INVENTION

The primary purpose of the Real Time Intervention and Prevention Platform (RTIP) is to enable an automated real time inquiry of disparate data sources across multiple domains, identify indicators and compute risk scores so that the appropriate personnel can be alerted when the risk level is above a pre-determined level and an intervention may be required. This can then trigger an intervention alert which then uses an Intervention Alert Notification engine to send it to the appropriate personnel so that appropriate intervention can be provided. The flow diagram for the manner in which the data is processed and monitored is depicted in FIG. 1.

In an embodiment, this invention provides a system for generating automated notifications. The system may include a computer having a processor, non-volatile memory, and a database, aggregator application, and dynamic risk computation engine residing in the non-volatile memory. The aggregator application accesses a plurality data sources wherein each data source addresses a general area of at-risk conduct and wherein the aggregator application generates reports on specific individuals and stores the reports in a database, and wherein the reports comprise metadata of contacts between the specific individuals and the data source, and wherein the reports of contacts do not violate HIPAA reporting requirements. A dynamic risk computation engine scores each individual for their risk of engaging in at-risk conduct according to metadata on contacts of that individual within the plurality of data sources. Any individual having a score exceeding a pre-determined threshold automatically triggers an alarm and a notification is provided in real time to responsible personnel to allow a competent authority to make a timely intervention.

In an embodiment, the at-risk or antisocial conduct comprises drug abuse, school disciplinary problems, violence, or criminal conduct. In an embodiment, the responsible person comprises a law enforcement agency, a social service agency, or school disciplinary authorities. In an embodiment, the data sources comprise law enforcement agencies, social service agencies, corrections agencies, educational agencies, hospitals, and EMS agencies.

DETAILED DESCRIPTION

To address this lack of communication, a consistent, standards-based information sharing approach can be implemented using a common platform that enables information sharing yet conforms to privacy and other requirements that are required under the various regulations (HIPAA, CJIS, etc.) It is anticipated that the end product of this effort will be a model that incorporates the manner in which a multi-disciplinary approach can be utilized and supported by a technology framework that support standards-based information sharing, a Concept of Operations (CONOPS) that defines the manner in which this will be implemented, a field-tested Privacy template and Memorandums of Agreements (MOUs) that will lay the foundation for use by other agencies at a similar stage of the process.

Figure 1:
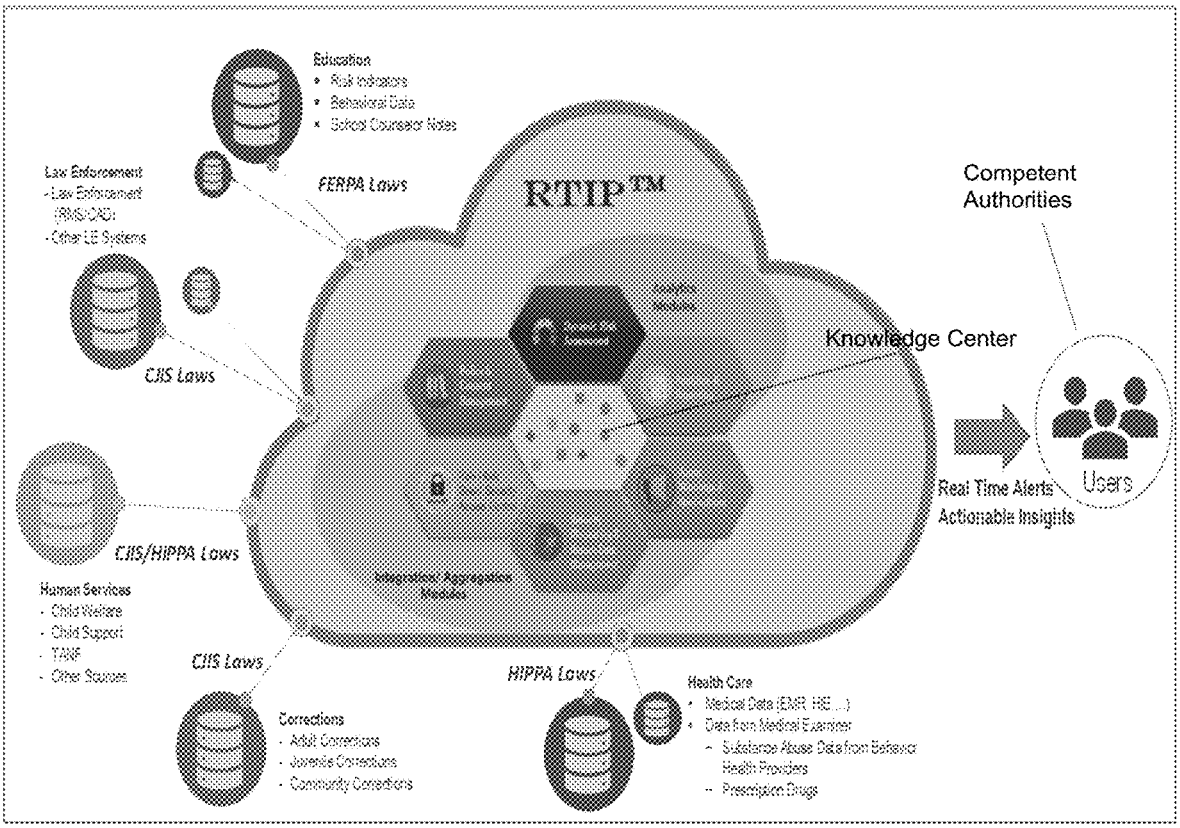
FIG. 1 is a schematic of the interrelationships of various players in the intervention of antisocial behavior.

A cartoon of the inventive system is illustrated in FIG. 1. Showing the interrelationships of various parts. This figure shows a central cloud encompassing the inventive system, termed the Real Time Intervention and Prevention Platform (RTIP). Various data sources on the left and below the cloud feed information into the RTIP. The data sources include education sources, law enforcement sources, social service agencies (public or private), corrections, and health care sources. Within the RTIP, information and aggregation modules process the data and feed into the Knowledge Center in the middle. The Knowledge Center contains one or more databases that store reports of incidents and other relevant information. A series of analytics modules is illustrated, including Dynamic Risk Assessment, Analytics and Reporting, and Alerts, Warnings and Notifications. The ultimate output are real-time, actionable alerts and insights delivered to competent authorities who may have the ability and legal power to intervene and prevent foreseeable dangerous acts from occurring. Thus, the inventive system is intended to prevent harm from at-risk or antisocial conduct, i.e., to intervene before an at-risk individual acts on an antisocial or otherwise harmful action. In another aspect, the problem solved by this invention is detecting and flagging at-risk individuals for intervention.

Figure 2:
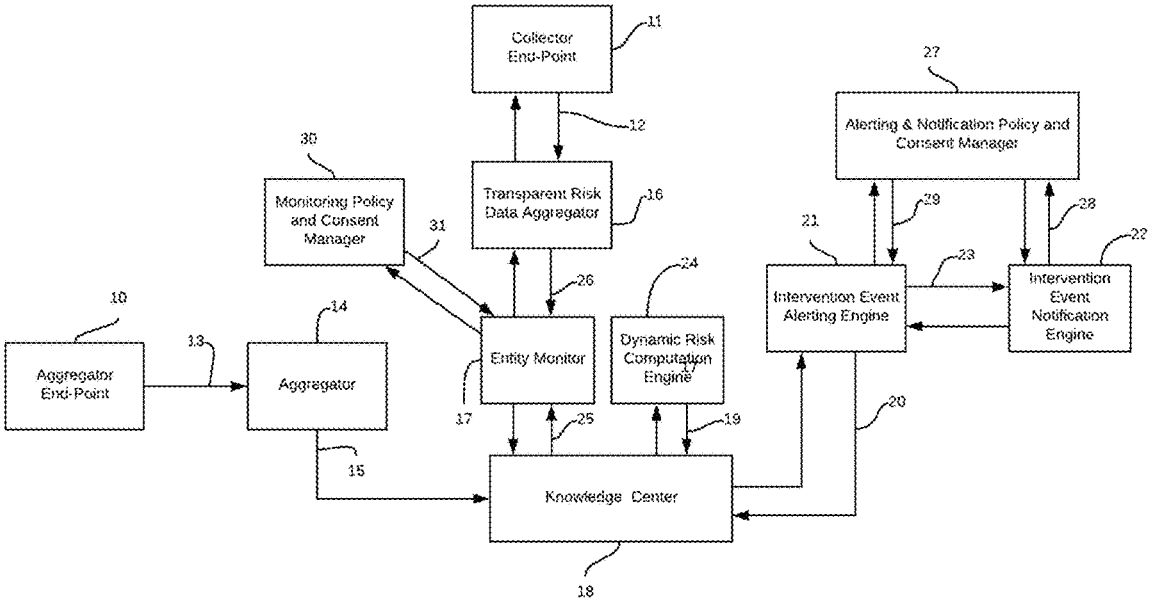
FIG. 2 is a block diagram of the parts of the inventive system.

As depicted in FIG. 2, the Knowledge Center (18) is a learning system which will comprise of a list of entities that are being monitored, entity statistics with normative patterns and risk scores. In an embodiment, whenever there is any change in the data in the source system the Aggregator End-Point (10) will collect the data based on policies and send the data thru the Aggregator connection (13) to the Aggregator (14). The Aggregator will collect the data and ensure that the data quality is uniform and standardized across the various data sources, and send it to the Knowledge Center (18) as reports of at-risk or antisocial conduct. This method is used with reliable, proven data sources that can provide reports of at-risk conduct without the need for further permissions or monitoring for access rights.

In an alternative embodiment the inventive system may use data sources that are less reliable or not vetted for consistency or relevance, or are external sources where access rights may be restricted. For such sources, the Entity Monitor (17) will communicate with a Transparent Risk Data Aggregator (16) module and collect risk factors from the disparate data sources thru the Collector End Point (11). The Entity Monitor (17) will obtain approval from the Monitoring Policy and Consent Approval Manager (30) before soliciting the Transparent Risk Data Aggregator (16) for collecting the information. Any information found will be sent back to the Transparent Risk Aggregator thru data connection (12). The Transparent Risk Aggregator standardizes the data and generates reports of at-risk conduct. The reports are then sent to the Knowledge Center to update the information in the Knowledge Center.

In an embodiment, the Knowledge Center (18) is local server computer or a cloud-based computer system, that communicates with users via a website. For example, the computer system may have a processor, non-volatile memory, and a database, aggregator application, and dynamic risk computation engine residing in the non-volatile memory.

In an embodiment, the Knowledge Center comprises at least one database that stores the reports from Aggregator (14) and Transparent Risk Aggregator (16), along with relevant information, such as the source of the report, the name and other identifying information of the subject individual, time and date stamps, and the actual report itself.

The reports of at-risk conduct will be then sent to the Dynamic Risk Computation Engine (24) thru connection (19). The Dynamic Risk Computation Engine constantly monitors activity in the Knowledge Center and generates risk scores for specific individuals. In an embodiment, the Dynamic Risk Computation Engine is an intelligent engine capable of learning patterns of various forms of at-risk conduct and for various individuals.

The risk scores are then sent back to the Knowledge Center from where it will be sent to the Alerting Engine. The Alerting Engine will then check for the Policy Engine as well as the Consent Engine. Once the Policy and Consent Engines approve the transaction, it will be sent to the Intervention Alert Notification Engine (22) to be sent to the appropriate personnel. In an embodiment, pre-determined thresholds may be established for various levels of intervention depending on the scores. When the pre-determined threshold is reached, an automated notification will be sent to relevant agency or person. For example, a person deemed at-risk for a drug overdose may be sent a notification to report to a social service agency. This means that the agency will be notified by the RTIP and the agency will in turn notify the at-risk person. In another example, a person deemed at-risk for a violent act may be visited by the police.

In an embodiment, competent authorities, also termed appropriate personnel, or responsible persons, may be law enforcement, school disciplinary authorities, social service agencies, employment supervisors, or any other agency or person with the authority to intervene with an at-risk individual. In some cases, depending on the situation and nature of the at-risk conduct, a competent authority may request that the person report to a facility, such as a social service agency or medical facility. In other cases, the competent authority may visit the person, by sending a social worker or police officer directly to intervene with the person.

The notifications in the inventive system are generated in real time. This generally means within minutes of a report being accessed by the inventive system. The likely bottleneck in this system, and source of delays, will be the ability of data source agencies to provide data in a timely manner, for example of school or police incidents. However, once such incidents are reported to the inventive system and digested the RTIP, reports are monitored in real time by the Dynamic Risk Computational Engine and if a score threshold is reached, the notification will be sent within minutes to the relevant competent authority. This means the notification will be sent within 30 minutes, or within 10 minutes, or within two minutes. This speed implies that notifications are delivered electronically the competent authority, for example by secure text message that generates an alarm when received the competent authority.

The intervention can include, for example, a visit from a social worker or police officer, a notification requesting that the person go to a social service office or medical facility, or the like. In an embodiment, the purpose of the interventions in the inventive system are disciplinary, therapeutic, and law-enforcement interventions. Disciplinary interventions usually imply that the at-risk person is in high school, and the discipline is in an educational context. Therapeutic interventions can be mental health or physical health interventions. Law enforcement interventions are for violations of state or federal criminal laws.

A technology component is the development of the Dynamic Risk and Predictive model using new Artificial Intelligence and Machine Learning techniques. The current risk model has been trained to predict the likelihood of an offender to commit similar or worse crimes over a certain time period. This risk model will adapt in real time to the ingestion of various indicators that can be gleaned from an individual's contact with law enforcement, or medical organizations.

Thus, in an aspect, the Dynamic Risk and Predictive model creates inferences of at-risk conduct, and notifies competent authorities or agencies to intervene before harm actually occurs.

The templates and methods of this invention should enable the sharing of cross-domain information across the justice and healthcare communities. This solution will allow for implementation of proven practices and will demonstrate the ability to leverage both the justice and healthcare standards (NIEM (https://www.niem.gov/) and HL7 (https://www.hl7.org/)). This approach will enable both the justice and health care agencies to exchange information while leveraging existing technology investments. The expected outcome of this program is to reduce opioid overdoses, outbreaks of violence, and other criminal and antisocial conduct.

The inventive method collects reports on at-risk individuals from various agencies such persons might come into contact with, such as law enforcement agencies, social service agencies, corrections agencies, educational agencies, hospitals, and EMS agencies. The reports all pertain to events relevant to at-risk conduct, for example drug abuse, school disciplinary problems, violence, suicide attempts, or criminal conduct. The reports are designed to avoid violating any HIPAA or privacy rules. Essentially, the reports comprise metadata of contact of the individual with the reporting agency. For example, a report from a law enforcement agency might report that a person had contact with a police officer, with no further detail, for example on whether the contact was for a traffic violation, or a more serious crime, or whether the person was charged with a crime. In another example, a report from a hospital may contain data that a person visited an emergency department, but the report would not contain any information on the purpose of the visit, a diagnosis, or treatments rendered, which might all require HIPAA permission. In another example, a reporting agency might be a parole office. In that case, a series of reports suggesting a pattern of meeting appointments would be a favorable factor suggesting a reduced risk for at-risk conduct.

Some highlights this approach include:

- An approach that leverages the concepts of cross domain information sharing and the Information Sharing environment (ISE).
- Use of Artificial Intelligence (AI) and Machine Learning to develop predictive risk models and identify individuals who have a higher imminent risk of a bad outcome.
- A team that has successfully implemented cross domain information sharing across a number of projects.
- An approach that utilizes all the Global products—GRA and a combination of HL7 and NIEM.
- Development of Concept of Operations and Privacy policies that can be re-used in other jurisdictions.

The efficiencies and benefits of this approach are:

- Enables a quicker implementation thus showing value very quickly.
- Highlights the benefits of using national standards to enhance and add information exchanges.
- Use of AI and Machine Learning techniques to enhance the predictive models and create dynamic risk models that support real time data ingestion.
- Creates a model that is replicable nationwide and highlights the use of standards In the area of addressing violence, including mass public shootings, common features of these events include:

- Data available in multiple siloed systems—lack of integration across domains such as Law Enforcement, Children Services, Health Care, etc.
- Inability to stitch information to provide a composite picture of an individual.
- Substantial amount of manual intervention required to "connect-the-dots," i.e., infer from various reports that an at-risk conduct is occurring or has a high likelihood of occurring.
- No continuous monitoring process to identify "Risk Level" of individuals in a dynamic manner.
- Inability to "flag" individuals as "High Risk" when incidents occur for timely intervention.
- Lack of automated systems to capture "tips and leads" from different sources to identify trends and patterns.

This invention approaches these issues by leveraging the Nationwide Suspicious Activity Reporting Initiative (https://www.dhs.goc/nsi), successfully used to combat domestic terrorism, concepts to deploy the School Violence Prevention solutions. This includes:

- NSI Architecture—Reuse and leveraging of Information Sharing concepts and technologies, Training Material, Standards based Information Sharing Materials, Privacy Policies, Concepts of Operations.
- Teams—Leverage the teams that have been focused on implementing the NSI and have the requisite skills to implement this very quickly.
- Leverage State Information Sharing concepts to link traditional and non-traditional state and local data sources.
- An automated system to collect "tips and leads" at schools and identify trends and patterns.

In an embodiment, the inventive system creates a dynamic Risk Profile that is modified based on current events in real time. That is, the Risk Profile can be modified from reports of at-risk conduct and inferences produced by the inventive system. Multi domain integration can enable the inventive system to identify any events or encounters with agencies that may have an effect on the Risk Profile. Real-time monitoring of cross domain systems may be used to track any changes that could elevate the Risk Profiles. And, an alerting system to alert appropriate personnel when the Risk Profile is elevated due to potential encounters.

Other features of this invention include implementing a Dynamic Risk model that monitors events in near real time. With this invention, policies can be implemented that ensure that alerts generated by the inventive system are triaged and action is taken.

This invention may also implement the ability to provide appropriate team members with information and alerts to enable them be proactive in interdicting at-risk individuals before dangerous conduct occurs.

In an embodiment, this invention integrates policy, process and technology to provide a holistic solution to intervening in at-risk conduct. This invention may also implement the ability to conduct peer-to-peer searches across state, local and national data sources to obtain a holistic picture of the actors.

The invention claimed is:

1. A system for generating automated notifications for the intervention of at-risk conduct by an individual, comprising a. a computer having a database, an aggregator application, and a dynamic risk computation engine;

b. wherein the aggregator application accesses metadata from contacts between the individual and a plurality data sources, wherein the data sources comprise law enforcement agencies, social service agencies, corrections agencies, educational agencies, hospitals, and EMS agencies, wherein each data source addresses a general area of at-risk conduct and wherein the aggregator application generates reports of incidents of at-risk conduct by specific individuals and stores the reports in a database, and wherein the reports comprise metadata of contacts between the specific individuals and the data source, and wherein the reports of contacts do not violate HIPAA reporting requirements and other privacy protection rules;

c. wherein a dynamic risk computation engine scores each individual for their risk of engaging in at-risk conduct according to the metadata on contacts of that individual within the plurality of data sources;

d. wherein any individual having a score exceeding a pre-determined threshold of at-risk conduct automatically triggers an alarm and a notification is provided in real time to competent authorities to allow a responsible person to make a timely intervention.

2. The method of claim 1, wherein the at-risk conduct comprises drug abuse, school disciplinary problems, violence, or criminal conduct.

3. The method of claim 1, wherein competent authorities comprises a law enforcement agency, a social service agency, or school disciplinary authorities.

* * * * *